United States Patent [19]

Imanishi et al.

[11] Patent Number: 4,631,934

[45] Date of Patent: Dec. 30, 1986

[54] WASHING MACHINE

[75] Inventors: Shoichi Imanishi, Yokohama; Yoshio Ikeda, Aichi, both of Japan

[73] Assignee: Kabushiki Kaisha Toshiba, Kawasaki, Japan

[21] Appl. No.: 828,607

[22] Filed: Feb. 12, 1986

Related U.S. Application Data

[63] Continuation of Ser. No. 623,195, Jun. 21, 1984, abandoned.

[30] Foreign Application Priority Data

Jun. 28, 1983 [JP] Japan ..... 58-116514

[51] Int. Cl.[4] ..... D06F 23/04

[52] U.S. Cl. ..... 68/23 R; 68/154; 68/174

[58] Field of Search ..... 68/23 R, 38, 53, 89, 68/136, 148, 154, 171, 172, 173, 174; 210/364, 365

[56] References Cited

U.S. PATENT DOCUMENTS 1,211,129 1/1917 Franklin ..... 68/89
2,575,691 11/1951 Smith ..... 68/174 X
2,648,964 8/1953 Graham ..... 68/174
2,652,710 9/1953 DeRemer ..... 68/23.2
2,986,916 6/1961 Bochan ..... 68/23 R X
4,202,187 5/1980 Hukuzawa et al. ..... 68/23 R X

FOREIGN PATENT DOCUMENTS 13469 5/1961 Japan .

*Primary Examiner*—Philip R. Coe
*Attorney, Agent, or Firm*—Cushman, Darby & Cushman

[57] ABSTRACT

A washing machine includes a washing tub whose peripheral wall is constituted by an upper peripheral wall section and a lower peripheral wall section which is located below the upper peripheral wall section and which is driven to rotate clockwise and counterclockwise. The washing tub receives water and laundry therein. In the case of a small load of laundry, the laundry is caused to flow, and to be washed due mainly to the flow or water caused by the rotation of the lower peripheral wall section. In the case of a large amount of the load of laundry, the laundry can be washed due to the synergetic action of the frictional forces. In such a washing machine, the inner surface of the upper peripheral wall section is made gradually smaller in diameter from its lower portion to its upper portion.

5 Claims, 3 Drawing Figures

WASHING MACHINE

This is a continuation of application Ser. No. 623,195, filed June 21, 1984 which was abandoned upon the filing hereof.

BACKGROUND OF THE INVENTION

The present invention relates to a washing machine comprising a washing tub including an upper peripheral wall section which is stationary in a washing mode and a lower peripheral wall section which is driven to rotate clockwise and counterclockwise in the washing mode, and more particularly, relates to a washing machine arranged such that a load or loads of laundry are received in the washing tub together with water, whereby, in the case of a small amount of laundry, the laundry is caused to cycle, and is washed, due mainly to the water flow caused by the rotation of the lower peripheral wall section, and, in the case of a large amount of laundry, the laundry is washed due to the friction of the laundry against the upper peripheral wall section, as well as due to the laundry cycle caused by the frictional force produced by its contact with the lower peripheral wall section.

In a prior art washing machine of a pulsator type wherein the water flow is caused by a pulsator, the laundry is washed as it follows the cycling water. In this type of washing machine, therefore, the washing tub is required to have a capacity large enough to handle a specified size of load. This means that the amount of the load of laundry capable of being washed at one time is small. Further, where the amount of laundry to be cleaned is too small, the flow of water becomes extremely intense causing the laundry to be washed excessively. On the other hand, where the amount of laundry to be washed is too large, the speed of the flow of the water decreases correspondingly, whereby the washing effect tends to become diminished. Further, in this type of washing machine, the laundry and the pulsator come into contact with each other only accidently and partly. For this reason, it can not be expected to attain a washing-by-rubbing effect, or a washing-by-friction effect for the entire load. Stated differently, it is pointed out with respect to this type of washing machine that a load or loads of laundry are likely to be washed unevenly, and to be damaged.

Meanwhile, a washing machine has been recently proposed in which no pulsator is provided and in which the washing tub as a whole is intermittently rotated in a state wherein water and the laundry are received therein, thereby obtaining a washing effect due to the difference in flow speed between the water and the laundry. This type of washing machine has a merit in that no damage is caused to the laundry. However, it has a demerit as well in that the washing effect is small because the motion of the laundry becomes simplified due to the small difference in flow speed between the water and the laundry.

SUMMARY OF THE INVENTION

The present invention has been achieved in view of the above-mentioned circumstances and is intended to provide a washing machine which makes it possible to not only produce a greater and more uniform washing effect than in the prior art without using a pulsator or without rotating the washing tub as a whole, but also to prevent the laundry from being damaged, which makes it possible to wash a larger amount of laundry at one time than in the prior art and, in addition, which widens the range in amount of the laundry within which a moderate washing effect can be maintained.

To attain the above object, according to one aspect of the present invention, there is provided a washing machine having a washing tub whose peripheral wall is constituted by an upper peripheral wall section and a lower peripheral wall section which is located below the upper peripheral wall section and which is driven to rotate clockwise and counterclockwise, said washing tub receiving water and laundry therein, wherein, in the case of a small load of laundry, the laundry is caused to flow, and to be washed, mainly due to the flow of water caused by the rotation of the lower peripheral wall section, and, in the case of a large amount of the load, the laundry can be washed due to the synergetic action of the two frictional forces: one of which is a frictional force produced by the laundry's contact with the lower peripheral wall section which causes the laundry to cycle; and the other of which is a frictional force produced by the friction between the laundry and the upper peripheral wall section, said washing machine being improved so that at least the inner surface of the upper peripheral wall section is made gradually smaller in diameter from its lower portion to its upper portion.

By constructing the present invention as one aspect of the above, it is possible to extend to the entire load of laundry both the washing-by-rubbing effect, which is produced by the friction between the laundry and the upper peripheral wall section along with the lower peripheral wall section, and the washing-by-friction effect between the laundry itself, as well as washing-by-massage effect which is produced as a result of the laundry receiving forces acting in different directions from both the upper peripheral wall section and lower peripheral wall section and being thereby massaged.

According to another aspect of the present invention, the washing machine is improved so that at least the inner surface of the upper peripheral wall section is made gradually larger in diameter from its lower portion to its upper portion.

By constructing the present invention as another aspect of the above, it is possible to enhance the washing effect.

DETAILED DESCRIPTION OF THE PREFERRED EMBODIMENT

One embodiment of a washing machine with a dehydrating function according to the present invention, will now be described with reference to the appended drawings.

Figure 1:
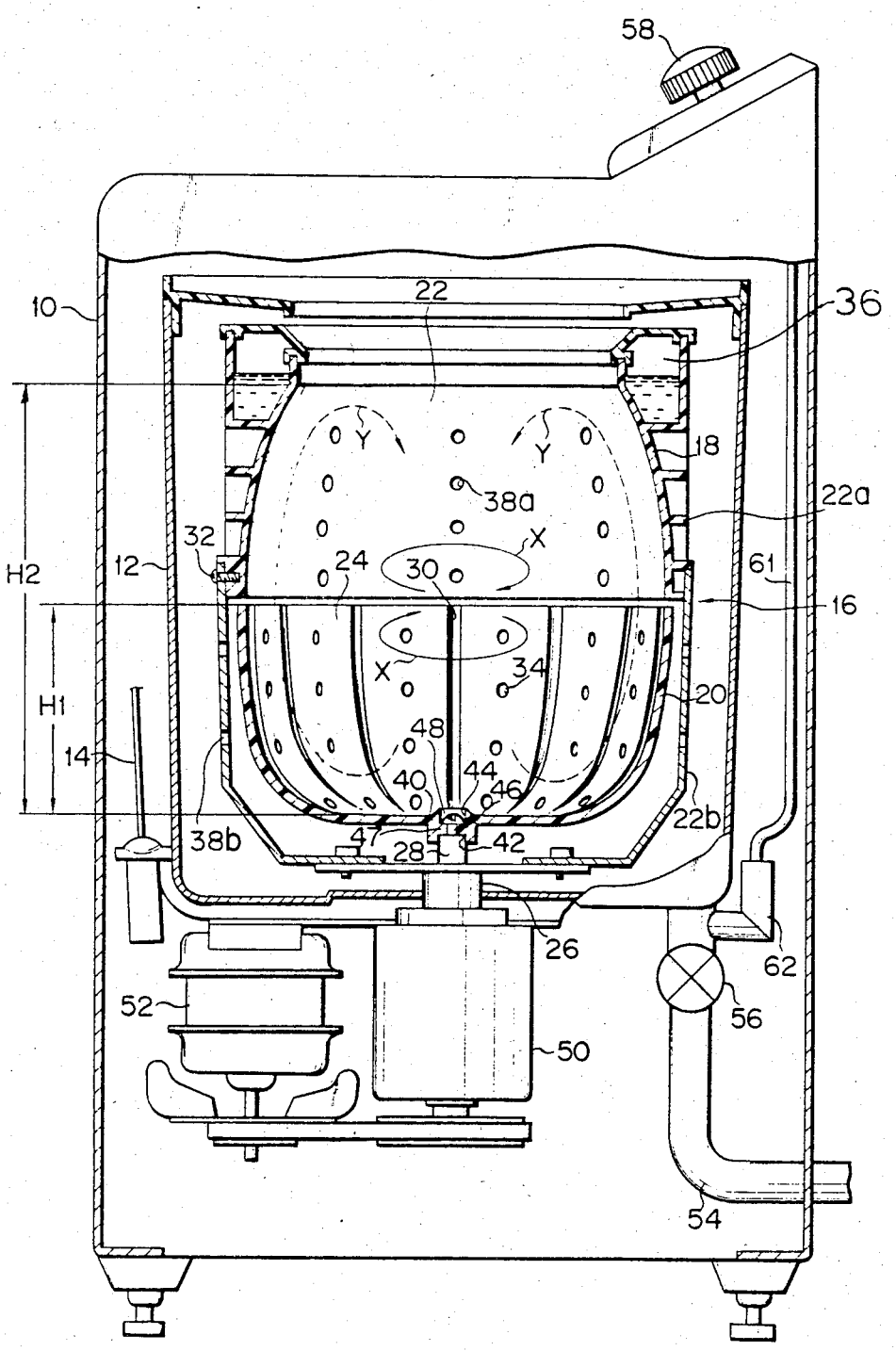
FIG. 1 is a vertically sectional view showing a washing machine according to one embodiment of the present invention.

In FIG. 1, reference numeral 10 denotes an outer casing of the washing machine having a dehydrating function. Within the casing 10, a water-receiving tub 12 is elastically supported through a suspension rod mechanism 14 so that it may be swingable with respect to the outer casing 10. Within the water-receiving tub 12, a washing tub 16 is rotatably received, the peripheral wall of which is constituted by an upper peripheral wall section 18, and a lower peripheral wall section 20 located beneath the upper peripheral wall section 18. Stated differently, the washing tub 16 is comprised of a tub 22 which rotates only during the dehydrating operation, not during the washing operation, and a shallow-vessel like stirring member 24 which is received in the substantially lower half of the tub 22 and which rotates together therewith the tub 22 at the time of the dehydrating operation and is driven, during the washing operation, to rotate in the clockwise and counterclockwise directions. The upper peripheral wall section 18 is constituted by a substantial upper half of the tub 22 while, on the other hand, the lower peripheral wall section 20 is constituted by a peripheral wall of the stirring member 24.

Hereinafter, the washing tub 16 will be described in detail. The tub 22 is rotatably disposed within the water-receiving tub 12. A hollow dehydrating shaft 26 is connected to the central part of the bottom wall of the tub 22. The stirring member 24 is disposed in such a manner as to fit against the inner peripheral-wall surface of the tub 22 and yet be coaxial therewith. The central part of the bottom wall of the stirring member 24 is connected to a washing shaft 28. This washing shaft 28 is provided in such a manner that it extends through the hollow dehydrating shaft 26. The upper end of the washing shaft 28 is allowed to protrude upwards from the inside surface of the bottom of the tub 22 and is attached to the undersurface of the stirring member 24.

The height H1 of the lower peripheral wall section 20 of the vessel-shaped stirring member 24 is set at a value equal to substantially one-half of the height H2 of the tub 22 ($H1 \approx H2/2$). The inner and outer side surfaces of the stirring member 24 are curved such that they become gradually larger in diameter from the lower portion toward the upper portion. On the inner sides of the stirring member 24, a plurality of grooves 30 are vertically extended substantially over the entire region. Further, a large number of first dehydrating apertures 34 are formed to cover substantially the entire region of the peripheral side surface of the vessel-shaped stirring member 24.

On the other hand, the tub 22 is constructed such that it includes an upper section **22*a* having only the upper peripheral wall section 18, and a lower tub section 22*b* provided facing to the lower peripheral wall section 20. Both upper and lower tub sections 22*a* and 22*b* are integrally coupled together by means of screws 32. The inner surface of the upper section 22*a* is curved such that it becomes gradually smaller in diameter from the lower portion toward the upper portion. Especially, in this embodiment, the inner surfaces of the stirring member 24 and upper section 22*a* curve outwards. The upper edge of the inner surface of the stirring member 24 and the lower edge of the inner surface of the upper section 22*a* vertically oppose each other, in other words, both inner surfaces of the stirring member 24 and upper section 22*a*** are aligned with each other, thereby forming a continuous surface.

In this embodiment, the washing tub 16 concurrently series as a dehydrating tub as well. For this reason, a balancer 36 is attached onto an upper end portion of the tub 22. Further, second dehydrating apertures **38*a* are formed in the upper cylindrical section 22*a* of the tub 22. Also, third dehydrating apertures 38*b* are formed to cover substantially the entire region of the lower tub section 22*b***.

A columnar projection 40 which protrudes vertically is provided at the center of the inner bottom surface of the stirring member 24. First and second recessed portions 42 and 44 are formed in the lower and upper end surfaces of that projection 40, respectively. Further, a communicating bore 46 for communicating the first recessed portion 42 with the second recessed portion 44 is formed in a partitioning wall portion 47 forming the respective bottom surfaces of the first and second recessed portions 42 and 44. The upper end portion of the washing shaft 28 is fitted into the first recessed portion 42. This washing shaft 28 is secured to the stirring member 24 by means of a screw 48 received into the second recessed portion 44 and inserted through the communicating bore 46.

The washing shaft 28 and dehydrating shaft 26 are connected to a washing machine motor 52 as a driving source, through a power control mechanism 50. This power control mechanism 50 transmits, during the washing operation, the rotational force of the washing machine motor 52 to the washing shaft 28 in a manner which reduces the speed of the rotation of the motor and, at the same time, which alternately reverses the direction of rotation to transmit and during the dehydrating operation, the rotational force to the dehydrating shaft 26 and, at the same time, to the washing shaft 28, thereby causing the tub 22 to rotate integrally with the vessel-shaped stirring member 24. For this reason, the power control mechanism 50 has built therein a speed reduction mechanism, clutch mechanism, brake mechanism, etc.

A drainage hose 54 is connected to the bottom portion of the water-receiving tub 12. A drainage valve 56 is mounted midway on the drainage hose 54. This drainage valve 56 controls the water draining from the water-receiving tub 12 and washing tub 16 through the drainage hose 54 to the outside of the machine.

Figure 2:
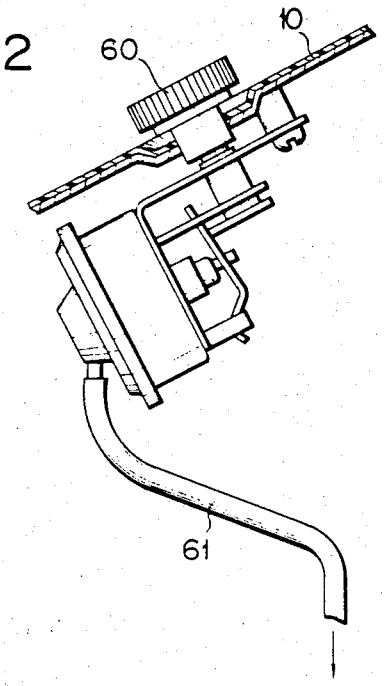
FIG. 2 is a view showing a water-level switch.

A timer device 58 is mounted on the upper portion of the outer casing 10 which controls the various aspects of the washing and dehydrating cycles. Further, on the upper portion of the outer casing 10, a water-level switch 60 is mounted in such a manner that it is juxtaposed with the timer device 58 as shown in FIG. 2. This water-level switch 60 is provided for the purpose of optionally setting the level of the water introduced into the washing tub 16. An air trap 62 (shown in FIG. 1) is connected to this water level switch 60 through a tube 61, said air trap being mounted on that portion of the drainage hose 54 between the drainage valve 56 and the water-receiving tub 12. The air trap 62 senses the pressure of the water received in the washing tub 16. The water level switch 60 controls, in accordance with the water level sensed by the air trap 62, the timing with which the operation of injecting water into the washing tub 16 is to be completed.

With the above-mentioned construction, when the washing operation is performed, the tub 22 is braked by the brake mechanism (not shown) so as to not rotate while, in contrast, the vessel-shaped stirring member 24 is driven by the motor 52 to rotate in the clockwise and counterclockwise directions. In this way, the peripheral wall portion of the tub 22 exposed above the peripheral wall of the vessel-shaped stirring member 24 functions the same way as the upper peripheral wall section 18 constituting a part of the peripheral wall of the washing tub 16. In the meantime, the peripheral wall of the vessel-shaped stirring member 24 functions the same way as the lower peripheral wall section 20 of the washing tub 16.

The action of the washing machine having the above-mentioned construction will now be described. At the start of washing cycle, as in an ordinary washing machine, the amount of water fed into the washing tub 16 should match the amount of laundry thrown in between the upper edge of the stirring member 24 and the lower edge of the balancer 36. Thus, the washing operation is performed by merely rotating the vessel-shaped stirring member 24 clockwise and counterclockwise while the tub 22 is stopped by the brake mechanism so as not to rotate. In this embodiment, the number of rotations of the vessel-shaped stirring member 24 is chosen to range from 120 to 180 round per minute and the direction of rotation is reversed in units of two to three rotations, i.e., every third or fourth rotation.

Meanwhile, in the washing operation performed in the above-mentioned manner, the laundry is allowed to contact the peripheral wall 20 of the vessel-shaped stirring member 24 and also the upper half portion of the peripheral wall of the tub 22. For this reason, by being brought into frictional contact with the stirring member 24, the lower portion of the laundry is imparted with a rotational force acting in a substantially horizontal plane as indicated by the arrow X. On the other hand, the upper portion of the laundry is imparted with a binding force by being brought into frictional contact with the tub 22. Because of the frictional forces acting in different directions in the above-mentioned manner, the laundry undergoes a twisting or pressing action. This twisting or pressing action is repeatedly imparted to the laundry through the reverse rotation of the vessel-shaped stirring member 24.

Further, because the laundry is pushed toward the peripheral wall of the washing tub 16 due to the centrifugal force resulting from the rotation of the vessel-shaped stirring member 24, a counteraction, or centripetal force acts inwards from the upper peripheral wall of the tub 22. As a result, streams of water which vertically revolve in the mutually opposite directions as indicated by arrows Y are produced, causing the laundry to move in a complicated way.

As stated before, in this embodiment, the vessel-shaped stirring member 24 is formed like a taper gradually becoming larger in diameter from its lower portion to upper portion. For this reason in particular, the movement or motion of the laundry due to the centrifugal force becomes smooth. Besides, the water also comes to move smoothly. In this manner both the laundry and the water come to rise up more easily. Further, since, in the mentioned embodiment, the inner surface of the upper section **22*a* of the tub 22, that is, the inner surface of the upper peripheral wall section 18 is curved such that it becomes gradually smaller in diameter from the lower portion toward the upper portion, the laundry thus rised up is pushed into the central portion of the washing tub 16, whereby the vertical revolution of the laundry (the movement of one item near the top to the bottom and vice versa) is promoted. Thus, the laundry undergoes the washing-by-rubbing action because of the great frictional contact between the items washed due to their complicated movements as well as to their frictional contact with the respective peripheral walls of the tub 22 and the vessel-shaped stirring member 24**. At the same time, the laundry undergoes a kind of washing-by-massage action over its entire mass through the repetition of the twisting and pressing actions as well. The laundry is thus thoroughly washed by thus undergoing the above-mentioned actions.

Further, in this embodiment a plurality of grooves 30 are provided on the inner peripheral side surface of the vessel-shaped stirring member 24. For this reason, the laundry undergoes a stronger washing-by-rubbing action, as well as a stronger rotational force. Accordingly, the washing-by-rubbing action, and the washing-by-massage action imparted to the laundry in the tub 22, are also increased. Thus, it is possible to obtain a very good washing effect.

Further, in this embodiment, as previously stated the laundry is moved by its frictional contact with the respective peripheral walls of the tub 22 and the vessel-shaped stirring member 24. Accordingly, as the amount of laundry increases, the frictional force involved also increases in magnitude. Accordingly, it is impossible that the readiness with which the laundry is moved be impaired by an increase in the load. Accordingly, any reduction in the washing effect would remain small even when the amount of laundry is increased. In addition, where the laundry load is small, the frequency of its contacting the peripheral wall of the vessel-shaped stirring member 24 becomes low and, at the same time, the frictional force resulting from such a contact also becomes small. Accordingly, the laundry is allowed to flow and to be washed by the stream of water caused to cycle in the whole interior of the washing tub due mainly to the low-speed rotation of the stirring member 24 having a large inner surface area. Since, therefore, the stream of water does not become excessively strong as compared with the stream of water created by the above-mentioned prior art washing machine of a pulsator type, even when the load of laundry is small, neither an excessive washing nor an insufficient washing takes place.

In this embodiment, since the inner surfaces of the upper section **22*a* of the tub 22 and the stirring member 24 curve outwardly, the vertical revolution of the laundry is promoted. In this case, since both surfaces of the stirring member 24 and upper section 22*a* are aligned with each other, the movement of the laundry is smoothed, thereby enhancing the vertical revolution of the laundry more smoothly. Further, since the inner surface of the upper section 22*a* of the tub 22 is curved such that is becomes gradually smaller in diameter from the lower portion toward the upper portion, the splush of water from the washing tub 16** will be prevented in the washing mode.

Figure 3:
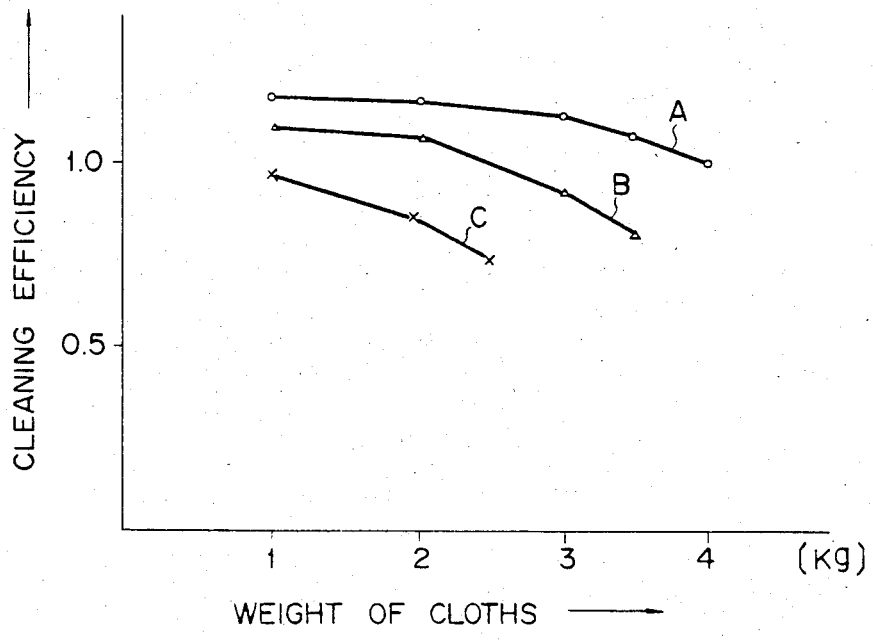
FIG. 3 is a diagram showing, as compared with the prior art, the relationship between the cleaning efficiency and the weight of the dirty laundry.

The fact that the washing or cleaning effect of the washing machine with a dehydrating function according to the present invention is excellent will be apparent from the graphic diagram shown in FIG. 3 as one example of the results of comparison. In FIG. 3, a curve A indicates the cleaning efficiency which is attained by the embodiment of the present invention. A curve B indicates the cleaning efficiency attained by a prior art washing machine of a pulsator type, and a curve C indicates the cleaning efficiency attained by a washing machine using only washing-tub rotation which was conceived prior to the present invention. It will be seen that the cleaning effect according to the embodiment of the present invention is high. Note here that said cleaning efficiency is regulated by JIS (Japanese Industrial Standard) C 9606.

The dehydrating operation according to this embodiment is performed by draining or discharging the water in the tub through the releasing of the drainage valve 56, and actuating the clutch mechanism (not shown), etc., thereby unidirectionally rotating the tub 22 integrally with the vessel-shaped stirring member 24.

The present invention is not limited to the above-mentioned embodiment, but permits various modifications to be made without departing from the spirit and scope of the invention. Hereinafter, various modifications will be described.

For example, although the above-mentioned embodiment has been described in the form that the invention is applied to a washing machine having a dehydrating function, the invention is not limited to such an embodiment, but may be applied to a washing machine having no dehydrating function. Accordingly, it is possible to construct the invention in the form of having the water-receiving tub omitted, by eliminating from the peripheral wall of the tub the aperture, and by storing water in said water-receiving tub per se. Further, the lower peripheral wall section 20 is not limited to the above-mentioned curved structure. It can also be made into a tapered structure having a greater diameter from lower portion toward the upper portion.

What is claimed is:

1. A washing machine, comprising a rotatable tub for holding laundry to be washed and having:

(a) a rotatable lower tub section;

(b) stirring means located within said lower tub section for rotating said laundry located in said lower tub section, said stirring means being formed with a plurality of holes therein for allowing water to be removed therefrom; and (c) a rotatable upper tub section, which includes means for causing vertical position shift of laundry contained therein formed from an inner wall of said upper tub section which gradually upwardly decreases in diameter from a lower portion to an upper-most portion, which upper-most portion is: (1) a position physically highest in vertical height from said lower tub section, and (2) a smallest diameter portion of said upper tub section, said causing means forcing said laundry in said tub to shift position vertically when said upper tub section is rotated; and means for independently rotating said upper tub section and said stirring means around a fixed vertical axis.

2. A washing machine as in claim 1 further comprising water receiving tub means, coaxially located to said tub, for filling with water when said laundry is desired to be washed.

3. A washing machine as in claim 2 further comprising drain means for draining said water from said machine at a predetermined time in a washing cycle.

4. A machine as in claim 1 further including control means for rotating only said lower tub section during a wash cycle, said rotation being both clockwise and counterclockwise for predetermined time periods during said wash cycle.

5. A washing machine for washing laundry, comprising:

an outer casing which is open at a substantially top end thereof;

a washing tub having a cross section of a circular shape, disposed within said outer casing in such a way as to be rotatable around a fixed vertical axis which axis intersects a center of said circular shape, said washing tub being formed with a closed bottom and an open top, and including:

(a) an upper section, including means for causing a vertical portion shift of laundry contacting therewith, said causing means constituted by an inner peripheral surface of said upper section which is formed with a gradually varying diameter that decreases from a largest diameter at a lower portion to a smallest diameter at an upper-most portion thereof and has no downwardly extending portions below said upper-most portion, so that said diameter of said inner peripheral surface decreases as the height of said upper section increases, thereby causing rotating laundry contacting therewith to be shifted in an upward direction, laundry in a central area of the tub thereby caused to be shifted in a downward direction, so that vertical revolution of the laundry is caused, and (b) a lower section, (c) said upper section and said lower section being separately rotatable, and (d) wherein said upper section is located above said lower section and a height of said lower section being at least half the height of said washing tub;

stirring means located within said lower section over an inner peripheral surface thereof and coaxial therewith, and which does not extend above a topmost portion of said lower section of said washing tub and is rotatable in synchronism with said lower section around said fixed vertical axis independently of said upper section, for stirring, in a substantially circular motion, laundry disposed therein, so that the laundry is rotated, thereby causing said vertical revolution of the laundry when the laundry contacts said causing means, said stirring means being formed with a plurality of water guiding holes therein for allowing water removal from said stirring means; and rotating means for: (1) in a washing mode, rotating only said stirring means and said lower section around said fixed vertical axis alternately in opposite directions and not rotating said upper section, and (2) in a dehydrating mode, rotating all of said stirring means, said lower section and said upper section in a single direction and around said fixed vertical axis.

* * * * *